US005670296A

United States Patent [19]

Tsai

[11] Patent Number: 5,670,296

[45] Date of Patent: Sep. 23, 1997

[54] METHOD OF MANUFACTURING A HIGH EFFICIENCY FIELD EMISSION DISPLAY

[75] Inventor: Chun-hui Tsai, Hsinchu, Taiwan

[73] Assignee: Industrial Technology Research Institute, Hsinchu, Taiwan

[21] Appl. No.: 497,766

[22] Filed: Jul. 3, 1995

[51] Int. Cl.[6] ..... H01J 9/227

[52] U.S. Cl. ..... 430/312; 430/318; 430/319; 430/25; 430/26; 445/24; 445/52

[58] Field of Search ..... 430/25, 26, 311, 430/312, 318, 319; 445/52, 24

[56] References Cited

U.S. PATENT DOCUMENTS

| | | | |
|---|---|---|---|
| 5,225,820 | 7/1993 | Clerc | 340/752 |
| 5,477,105 | 12/1995 | Curtin et al. | 313/422 |
| 5,508,584 | 4/1996 | Tsai | 445/24 |

*Primary Examiner*—John A. McPherson
*Attorney, Agent, or Firm*—George O. Saile; Stephen B. Ackerman

[57] ABSTRACT

A high efficiency field emission display, and a method for manufacturing such a display, having reduced driver circuit requirements, and which may be operated over a range of anode voltages while efficiently using existing phosphors, is described. A field emission display having a baseplate and an opposing face plate, includes a glass plate acts as a base for the faceplate. There is a patterned layer, having openings, of black matrix material over the glass plate. A plurality of phosphorescent elements are formed in and adjacent to the openings in the black matrix layer. A metal film overlays a portion of the top surface of each of the phosphorescent elements. The metal film may be patterned in a mesh or in other shapes, and provides for the highly efficient operation of the display of the invention. The baseplate, formed on a substrate, is mounted opposite and parallel to the faceplate, and has a conductive layer over the substrate. A plurality of electron-emitting tips formed on the baseplate extend through openings in the conductive layer, and are opposite to the phosphorescent elements. Finally, there is a means for establishing a differential voltage between the conductive layer and the metal film.

12 Claims, 4 Drawing Sheets

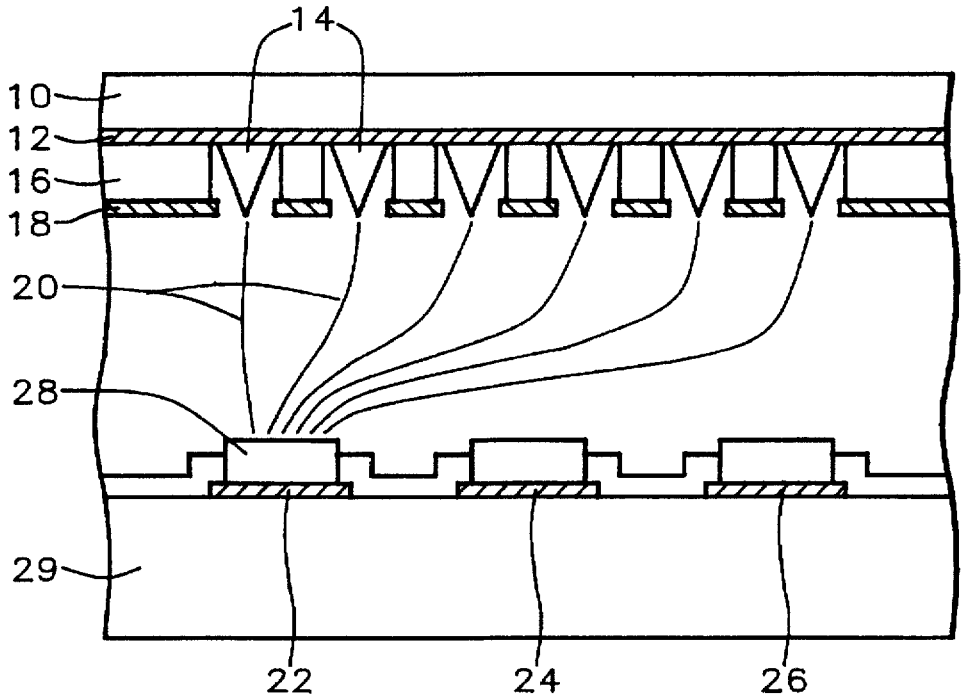
FIG. 1 – Prior Art
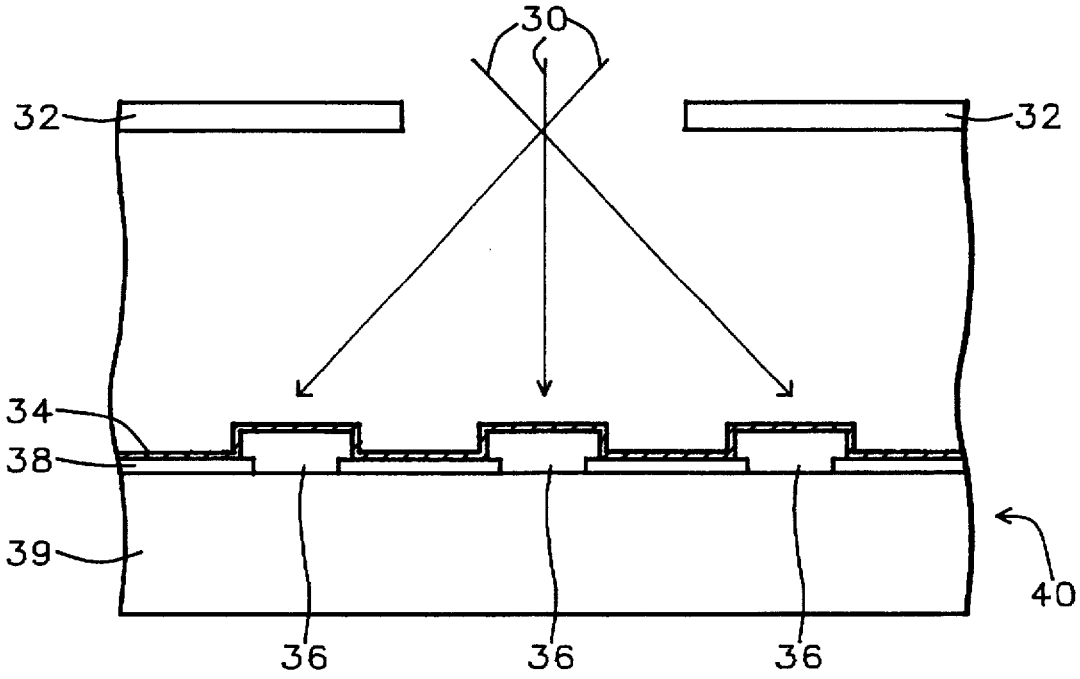
FIG. 2 – Prior Art

METHOD OF MANUFACTURING A HIGH EFFICIENCY FIELD EMISSION DISPLAY

BACKGROUND OF THE INVENTION (1) Field of the Invention

The invention relates to field emission flat panel displays, and more particularly to structures and methods of manufacturing field emission displays having a faceplate in which the anode is formed on the interior surface of the phosphor.

(2) Description of the Related Art

There is a growing need in the computer and electronics industries for thin, lightweight display panels. One application for such thin displays is for portable computers. The most commonly used display panel at the current time is the liquid crystal display (LCD), but because of the slow optical response time of the liquid crystal pixel to turn on and off, and because of its relatively poor luminosity, other display technologies are being actively explored.

One such technology which has the potential to provide faster response times and increased brightness, while maintaining a thin profile and low power consumption, is the Field Emission Display (FED). An FED typically consists of an array of small cold cathode electron emitters mounted on a substrate, from which emitted electrons are accelerated through an evacuated space to an opposing anode. The emitted electrons strike cathodoluminescent material (phosphors), causing light to be emitted, which may be viewed through a glass viewing surface on which the anode and phosphors are mounted.

The array of very small, conically shaped electron emitters is electrically accessed by peripheral control and image forming circuits, using two arrays of conducting lines that from columns and rows. The array of column lines form the cathode contacts on which the conical electron emitters are formed. The array of row conducting lines form gate electrodes that are separated by a dielectric layer from the column lines. The column lines are formed on the substrate, and both the gate electrodes and dielectric layer have openings over the column lines, in which the emitters are formed. The edges of the openings in the gate electrodes are in close proximity to the emitter tip, and function as the electrically addressable gate electrode, or control grid, for the individual electron emitters.

FIG. 1 is a cross-sectional view of a color field emission display of the related art, as disclosed in U.S. Pat. No. 5,225,820, in which anode switching is used to select the color(s) to be emitted from each pixel (or display picture element). Row electrodes 12 are formed on an insulating baseplate 10, and have emitter tips 14 mounted thereon. The emitters are separated by insulating layer 16. A column electrode 18, or gate, with openings for the emitter tips, is formed on the insulating layer 16 and is formed perpendicular to the row electrodes. When electrons 20 are emitted, they are attracted to conductive anode(s) 22, 24 and/or 26, depending on which of the anode(s) has been activated. In FIG. 1, anode 22 has an applied voltage much higher than that of anodes 24 and 26, and so electrons 20 are attracted to it. Upon striking phosphor 28, light is emitted. By switching the anode, less driver circuitry is needed for the cathode/gate, and the anode voltage is variable to compensate for the efficiency variation of different color phosphors.

The structure of FIG. 1 has disadvantages, however. The anode voltage is limited to about 1000 volts, since at higher voltages breakdown would occur between adjacent anodes in which one was switched on and the other off. At this voltage, less efficient phosphors must be used than could be used at higher voltage. Further, secondary electrons reduce the effective potential at the anode—when high energy electrons strike the phosphor surface, some electrons inside the surface are excited and escape out of the surface. These escaped electrons surround the phosphor surface thus reducing the potential of the anode.

The technology for manufacturing cathode ray tubes (CRT) for televisions, computer displays and the like, consists of well-established, mature processes and structures, and is illustrated in FIG. 2. Electrons 30 travel through shadow mask 32 and are attracted to anode electrode 34, which is formed of an aluminum film over the surface of the CRT faceplate. As can be seen in comparing FIGS. 1 and 2, the CRT anode electrode 34 is formed on the interior surface (with respect to the glass viewing surface 39) of the phosphors 36, as opposed to the typical FED (FIG. 1) structure in which the phosphor is formed interior to the anode electrode (with respect to glass 29). Phosphors 36 emit light when electrons strike through the aluminum surface, and are separated and insulated from each other by black matrix 38. The black matrix 38 is typically formed of carbon, and improves the display contrast. At the high voltages at which CRTs are operated, on the order of 20,000–30,000 volts, very efficient phosphors have been developed and are used. However, the CRT faceplate structure 40 is not amenable to use in FEDs for several reasons. The extremely high voltages could not be used in an FED due to the close gate-anode spacing. Also, a constant anode voltage is required and so there would be no saving of driver circuitry like in the switched anode design of FIG. 1.

SUMMARY OF THE INVENTION

It is therefore an object of this invention to provide a field emission display that has reduced driver circuit requirements, and can be operated over a range of anode voltages while efficiently using existing phosphors.

It is a further object of this invention to provide a method for manufacturing a field emission display that has reduced driver circuit requirements, and can be operated over a range of anode voltages using existing phosphors.

These objects are achieved by a field emission display having a baseplate and an opposing face plate, in which a glass plate acts as a base for the faceplate. There is a patterned layer, having openings, of black matrix material over the glass plate. A plurality of phosphorescent elements are formed in and adjacent to the openings in the black matrix layer. A metal film overlays a portion of the top surface of each of the phosphorescent elements. The baseplate, formed on a substrate, is mounted opposite and parallel to the faceplate. There is a conductive layer over the substrate. A plurality of electron-emitting tips formed on the baseplate extend through openings in the reflective, conductive layer, and are opposite to the phosphorescent elements. Finally, there is a means for establishing a differential voltage between the conductive layer and the metal film.

These objects are further achieved by a method of manufacturing a faceplate with a glass base for a field emission display. A photoresist layer is formed over the glass base. Openings are formed in the photoresist layer. Black matrix elements are formed in the openings. The photoresist layer is removed, whereby there is formed a first, second and third set of openings in the black matrix elements. First phosphorescent strips are formed in the first set of openings. Second phosphorescent strips are formed in the second set of openings. Third phosphorescent strips are formed in the third set of openings. A planarizing layer is formed over the first, second and third phosphorescent strips and over the black matrix elements. A metal layer is deposited over the planarizing layer. The metal layer is patterned to form a metal mesh, or into other patterns such as solid strips, over a portion of each of the first, second and third phosphorescent strips, and the planarizing layer is removed.

BRIEF DESCRIPTION OF THE DRAWINGS

FIG. 1 is a cross-sectional representation of a prior art field emission display having a switched anode.

FIG. 2 is a cross-sectional representation of a prior art CRT structure.

DESCRIPTION OF THE PREFERRED EMBODIMENTS

Figure 3:
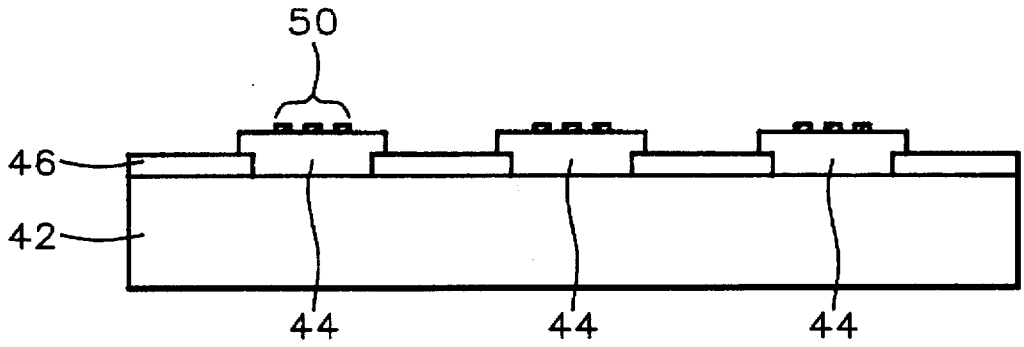
FIG. 3 is a cross-sectional representation of the novel structure of the invention for an FED faceplate.
Figure 4:
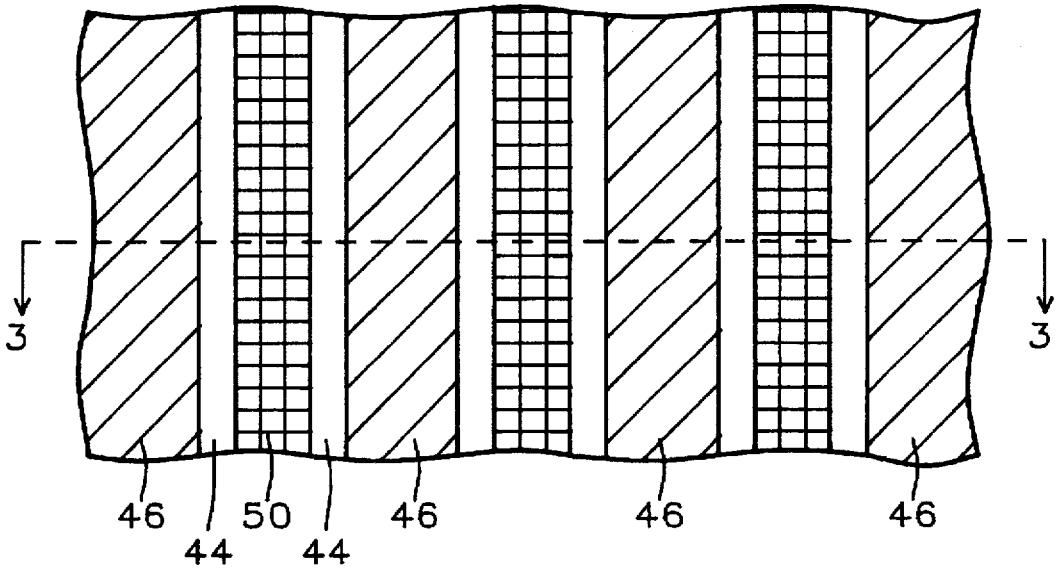
FIG. 4 is a top view of one layout of the FED anode of the invention, with the FIG. 3 cross-section taken along line 3—3.
Figure 5:
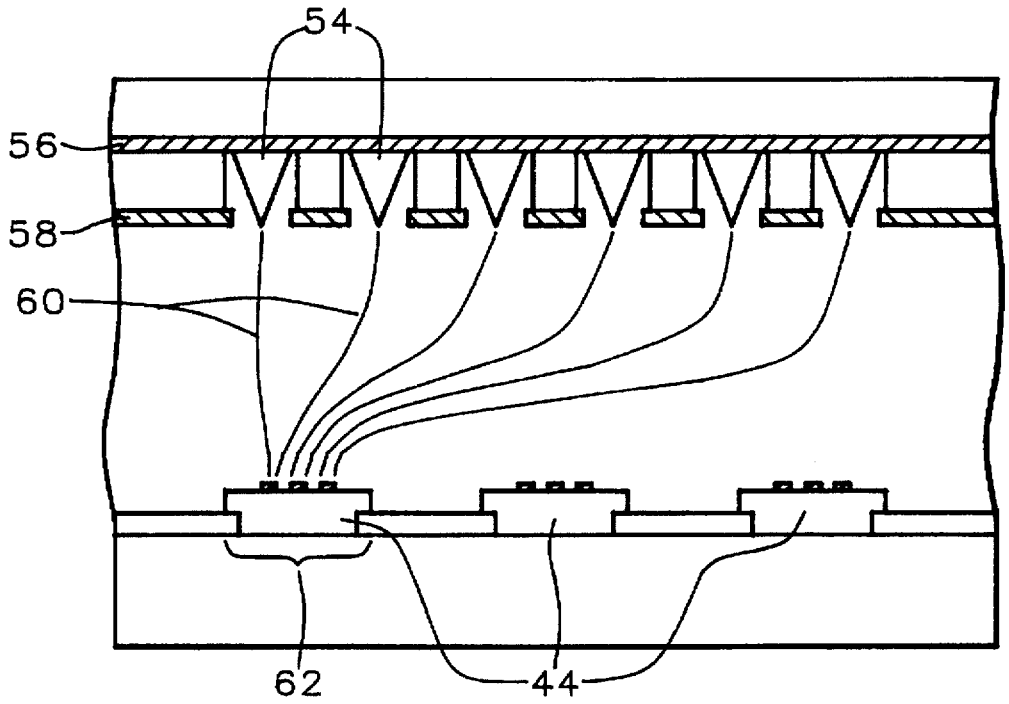
FIG. 5 is a cross-sectional representation of operation of the FED faceplate of the invention mounted to a backplate having electron emitting elements.
Figure 6:
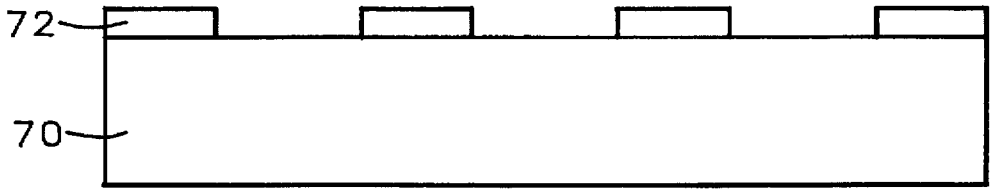
FIG. 6 to 10 are cross-sectional representations of the method of the invention for forming a field emission display.

Referring now to FIGS. 3 to 5, the novel structure of the invention is demonstrated. The drawings represent the faceplate of a field emission display (FED) which would be observed by a user of the display through glass 42. The phosphorescent elements 44 are formed of three different phosphor compounds that emit red, green and blue light, so that differing color combinations may be displayed at each of the picture elements of a color FED. Black matrix elements 46, as noted earlier, provide contrast to improve the displayed image.

An important aspect of the invention is a metal film which is formed over a portion of each of the phosphorescent elements 44. The metal acts as the display anode, and is formed in a meshed structure 50. This structure allows for a wide range of operation, from a few volts to several thousand volts.

Electrons emitted from the micro tips will be attracted to the meshed anode 50. A small number of the electrons, the number depending on the mesh design, will strike the mesh metal and lose their energy. Most of the electrons will pass through the regions in which there is no metal and impact on the phosphor, transferring their energy to light and thus producing the display image.

When electrons strike a metal film, the energy loss is on the order of several thousand volts, depending on the film thickness and material. This is one reason why the operating voltage of a CRT is so high. If the metal film is removed, most phosphors can be operated at a lower voltage and at higher efficiency.

FIG. 3 is a cross-sectional view along line 3—3 of FIG. 4, in which a mesh structure 50 is shown. Differing variations in the layout of the metal film may be used to optimize display operation, brightness, etc.

The novel structure of the invention prevents the high voltage breakdown problem inherent to the anode switching method of the prior art. High voltage breakdown can be understood by referring to FIG. 1. The phosphors 28 typically adhere to the surface on which they are mounted by van der Waals force. If the electric field that exists between gate electrode 18 and anode electrode 22 during display operation becomes greater than the van der Waals force, the phosphors will be undesirably attracted to gate electrode 18, and this phenomenon is known as high voltage breakdown. In the structure of the invention, on the other hand, it can be seen in FIG. 5 that the phosphors 44 are outside of the field that is generated between the metal mesh anode electrode 50 and the gate electrode 58, so that breakdown does not occur, regardless of the magnitude of the voltage level applied to the anode electrode 50.

Furthermore, the problem of secondary electrons is prevented, because the metal mesh 50 serves to conduct any secondary electrons back to the anode voltage source. Since phosphor is a good insulator, in the prior art structure of FIG. 1 secondary electrons generated at the surface of the phosphor opposite to the anode electrode are not conducted away, and lead to a decrease in phosphor efficiency. In the inventive structure of FIG. 5, on the other hand, secondary electrons generated at the phosphor surface are conducted away by the metal mesh 50 found on the same surface.

In addition, prior art FED designs such as that in FIG. 1 require a transparent conductor for the anode, such as indium tin oxide (ITO), so that emitted light will not be blocked from viewing through the glass front. The structure of the invention, on the other hand, has no requirement for anode transparency, and so a metal such as aluminum, gold or silver may be used. These metals offer better conductivity than transparent conductors such as ITO. They also offer process advantages—ITO film must be deposited by sputtering, while the metal films are more simply formed by thermal evaporation.

The FED faceplate structure of the invention is mounted opposite a backplate on which are formed the field emission tips 54, cathode 56, gate 58, etc., previously described, and as shown in FIG. 5. Shown is the structure of the invention in which a single anode/phosphor 62 has been activated which attracts the electrons 60 emitted within the particular picture element shown.

Referring now to FIGS. 6 to 10, the method of the invention is described. A transparent glass faceplate 70 is provided, having a thickness of between about 1 and 10 millimeters. Black matrix is formed by first patterning a negative photoresist layer, then spraying a carbon (dag spray) layer having a thickness of between about 5 and 50 micrometers. Sulfamic acid spray is then applied and development is performed, removing the photoresist and excess carbon, leaving black matrix 72 patterned as in FIG. 6.

Figure 7:
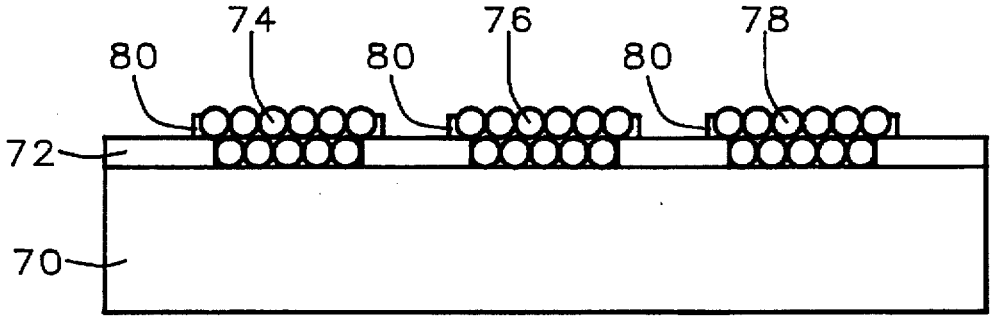

Phosphors 74, 76 and 78 is then formed, in the pattern shown in FIG. 7, by deposition, exposure and development of light sensitive polyvinyl alcohol (PVA) resist, to produce the desired pixel color. These steps are performed three times, as shown in FIG. 7, using three PVA slurries containing red- 74, green- 76 and blue- 78 light emitting phosphors, and PVA slurry 80.

Figure 8:
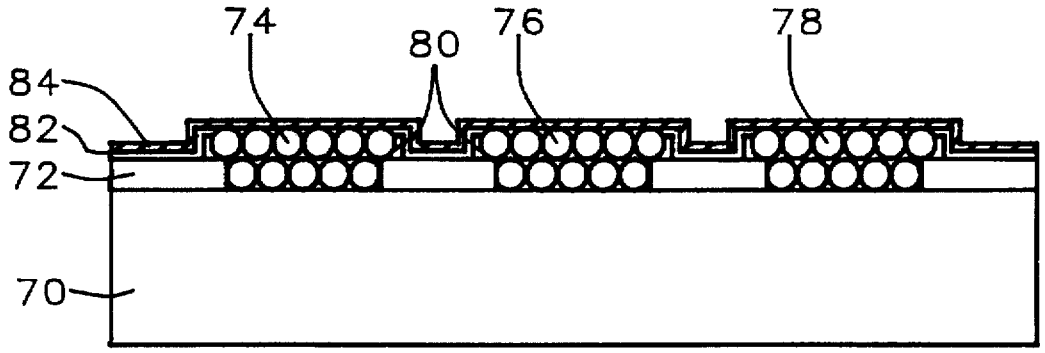

With reference to FIG. 8, a planarizing film 82 is deposited by spin coating to a thickness of between about 1 and 10 micrometers. Metal film 84 is then deposited by thermal evaporation to a thickness of between about 500 and 5000 Angstroms. This film is formed of aluminum, gold, silver or the like.

Figure 9:
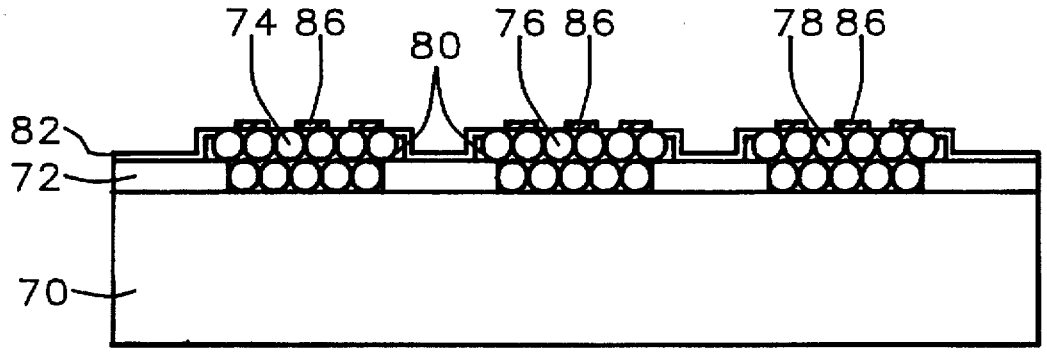

In an important step of the invention, the metal film is patterned, such as is shown in FIG. 9, to form the metal anode 86 of the FED. A photoresist (not shown) mask is formed by conventional lithography and then the metal film patterned by etching with a suitable etching solution, such as HCl (hydrochloric acid) for aluminum, or aqua regia for gold or silver. The anode elements 86 are formed into a mesh structure, as depicted in FIG. 9 or into other patterns such as solid strips.

Figure 10:
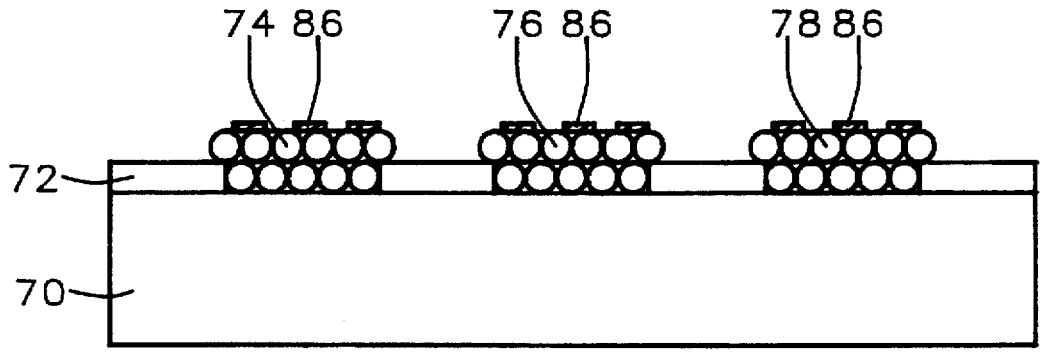

Finally, as shown in FIG. 10, the PVA slurry 80 and planarizing film 82 are removed by thermal burnout to a temperature of about 450° C. in an $N_2$ environment, or alternately in a vacuum.

The faceplate structure is mounted to a baseplate on which has already been formed field emission microtips, as shown and described previously in FIG. 5. The formation of the baseplate and emitters will not be described in detail as it is known in the art and not significant to the invention. Many thousands, or even millions, of microtips are formed simultaneously on a single baseplate in the formation of a field emission display.

While the invention has been particularly shown and described with reference to the preferred embodiments thereof, it will be understood by those skilled in the art that various changes in form and details may be made without departing from the spirit and scope of the invention.

What is claimed is:

1. A method of manufacturing a faceplate with a glass base for a field emission display, comprising the steps of:

forming a photoresist layer over said glass base;

forming openings in said photoresist layer;

forming black matrix elements in said openings;

removing said photoresist layer, whereby there is formed a first, second and third set of openings in said black matrix elements;

forming first phosphorescent strips in said first set of openings;

forming second phosphorescent strips in said second set of openings;

forming third phosphorescent strips in said third set of openings;

depositing a planarizing layer over said first, second and third phosphorescent strips and over said black matrix elements;

depositing a metal layer over said planarizing layer;

patterning said metal layer to form metal strips over a portion of each of said first, second and third phosphorescent strips; and removing said planarizing layer.

2. The method of claim 1 wherein said metal layer is selected from the group consisting of aluminum, gold and silver.

3. The method of claim 1 wherein said metal film is deposited by thermal evaporation, to a thickness of between about 500 and 5000 Angstroms.

4. The method of claim 1 wherein said metal strips are patterned to form solid strips.

5. The method of claim 1 wherein said metal strips are patterned to form meshed strips.

6. The method of claim 1 wherein said first phosphorescent strips are formed of a red light emitting material, said second phosphorescent strips are formed of a green light emitting material, and said third phosphorescent strips are formed of a blue light emitting material.

7. The method of claim 1 wherein said planarizing layer is removed by thermal burn-out.

8. A method of manufacturing a field emission display, having a faceplate with a glass base, in which the faceplate is mounted parallel and opposite to a baseplate that has a plurality of field emission microtips extending up from a substrate through openings formed in a sandwich structure of an insulating layer and a conductive layer, comprising the steps of:

forming a photoresist layer over said glass base;

forming openings in said photoresist layer;

forming black matrix elements in said openings;

removing said photoresist layer, whereby there is formed a first, second and third set of openings in said black matrix elements;

forming first phosphorescent strips in said first set of openings;

forming second phosphorescent strips in said second set of openings;

forming third phosphorescent strips in said third set of openings;

depositing a planarizing layer over said first, second and third phosphorescent strips and over said black matrix elements;

depositing an metal film over said planarizing layer;

patterning said metal film to form metal strips over a portion of each of said first, second and third phosphorescent strips; and removing said planarizing layer.

9. The method of claim 8 wherein said metal strip is deposited by thermal evaporation, to a thickness of between about 500 and 5000 Angstroms.

10. The method of claim 8 wherein said metal strips are patterned to form solid strips.

11. The method of claim 8 wherein said metal strips are patterned to form meshed strips.

12. The method of claim 8 wherein said first phosphorescent strips are formed of a red light emitting material, said second phosphorescent strips are formed of a green light emitting material, and said third phosphorescent strips are formed of a blue light emitting material.

* * * * *